US010964285B2

(12) United States Patent
Kuo et al.

(10) Patent No.: US 10,964,285 B2
(45) Date of Patent: Mar. 30, 2021

(54) DRIVER CHIP OF A DISPLAY PANEL WITH HIGH RESOLUTION DISPLAY

(71) Applicant: FORCELEAD TECHNOLOGIES CORP., Hsinchu County (TW)

(72) Inventors: Chih-Lung Kuo, Hsinchu County (TW); Wen-Lin Yang, Hsinchu County (TW)

(73) Assignee: Forcelead Technologies Corp., Jhubei (TW)

( * ) Notice: Subject to any disclaimer, the term of this patent is extended or adjusted under 35 U.S.C. 154(b) by 0 days.

(21) Appl. No.: 14/972,607

(22) Filed: Dec. 17, 2015

(65) Prior Publication Data

US 2016/0171952 A1 Jun. 16, 2016

Related U.S. Application Data

(60) Provisional application No. 62/065,806, filed on Oct. 20, 2014.

(51) Int. Cl.

| | |
|---|---|
| ***G09G 3/30*** | (2006.01) |
| ***G09G 3/36*** | (2006.01) |
| ***G09G 3/20*** | (2006.01) |

(52) U.S. Cl.

CPC ..... *G09G 3/3696* (2013.01); *G09G 3/20* (2013.01); *G09G 2300/0426* (2013.01); *G09G 2310/0278* (2013.01); *G09G 2330/021* (2013.01)

(58) Field of Classification Search

CPC ..... G09G 3/36–38; G09G 3/18; G09G 2310/0264–0297

See application file for complete search history.

(56) References Cited

U.S. PATENT DOCUMENTS

| | | | | |
|---|---|---|---|---|
| 2006/0012745 | A1* | 1/2006 | Kobayashi | G02F 1/13452 349/152 |
| 2006/0132417 | A1* | 6/2006 | Shigenobu | G09G 3/3696 345/98 |
| 2007/0076159 | A1* | 4/2007 | Lee | G02F 1/13452 349/149 |
| 2008/0100558 | A1* | 5/2008 | Yu | G09G 3/3677 345/100 |
| 2009/0167675 | A1* | 7/2009 | Park | G02F 1/13452 345/102 |
| 2011/0169792 | A1* | 7/2011 | Shimizu | G02F 1/1309 345/204 |
| 2014/0078190 | A1 | 3/2014 | Wu et al. | |
| 2014/0368485 | A1* | 12/2014 | Liu | G09G 3/3696 345/211 |

FOREIGN PATENT DOCUMENTS

| | | |
|---|---|---|
| CN | 101261822 A | 9/2008 |
| JP | 2000-305061 A | 11/2000 |

(Continued)

*Primary Examiner* — Sanghyuk Park

(74) *Attorney, Agent, or Firm* — Rosenberg, Klein & Lee

(57) ABSTRACT

The present invention provides a driver chip comprising a gate driving module and a source driving module both coupled to a display panel. A plurality of scan lines and a plurality of data line of the display panel scan and drive the display panel for displaying a frame. The source driving module is coupled to the mainboard and receives the positive and negative voltage of the mainboard for generating a source signal to the display panel.

14 Claims, 4 Drawing Sheets

(56) References Cited

FOREIGN PATENT DOCUMENTS

| | | | |
|---|---|---|---|
| JP | 2004-354567 | A | 12/2004 |
| JP | 2005-62582 | A | 3/2005 |
| JP | 2005-114806 | A | 4/2005 |
| JP | 2005164924 | A | 6/2005 |
| JP | 2005-266017 | A | 9/2005 |
| JP | 2006-189806 | A | 7/2006 |
| JP | 2008-40499 | A | 2/2008 |
| JP | 2008-191443 | A | 8/2008 |
| JP | 2009-251028 | A | 10/2009 |
| JP | 2011-253033 | A | 12/2011 |
| KR | 10-2008-0037187 | A | 4/2008 |
| KR | 10-2010-0076595 | A | 7/2010 |
| TW | 200523862 | A | 7/2005 |
| TW | 200641757 | | 12/2006 |
| TW | 200723188 | | 6/2007 |
| TW | 200937382 | A | 9/2009 |
| TW | 201123163 | A | 7/2011 |
| TW | 201335924 | A | 9/2013 |

* cited by examiner

DRIVER CHIP OF A DISPLAY PANEL WITH HIGH RESOLUTION DISPLAY

FIELD OF THE INVENTION

The present invention relates generally to a high resolution display, and particularly to a driver chip applied to a high resolution display.

BACKGROUND OF THE INVENTION

As the industry develops, digital tools such as mobile phones, digital cameras, notebook computers, desktop computers are developing towards the trend of more convenience, more functions, and designs that are more appealing. The displays of these electronic products are indispensable human-machine interfaces and are able to facilitate operational convenience for users. As the image processing technology develops, in order to fully utilize frames, the resolution of displays must be increased. Up to date, products with 5 K resolution have been announced.

The circuit design inside a high resolution display is complicated and requiring multiple voltages. Thereby, multiple voltages are required for a driver chip for high resolution display. According to the prior art, in order to supply various voltages to a driver chip, multiple capacitors are disposed on the flexible printed circuit (FPC) for boosting voltage and the boosted voltage is supplied to the internal module of the driver chip. Nonetheless, the capacitors on FPC result in an increase in cost.

Accordingly, in order to use no capacitor on FPC, the present invention provides a high solution display for reducing the cost of display.

SUMMARY

An objective of the present invention is to provide a driver chip, which receives the voltage supplied by the mainboard directly and drives the display panel.

Another objective of the present invention is to provide a high resolution display with FPC having no capacitor and thus reducing display cost.

In order to achieve the objectives and efficacies as described above, the present invention discloses a driving circuit for a high resolution display.

According to an embodiment of the present invention, a driver chip is provided. The driver chip comprises a gate driving module and a source driving module. The gate driving module is coupled to a display panel and generates a plurality of scan signals, which scan the display panel via a plurality of scan lines. The source driving module is coupled to the display panel and drives the display panel via a plurality of data lines. The source driving module is coupled to a mainboard and receives a positive voltage and a negative voltage generated by the mainboard for generating a plurality of source signals to the display panel.

According to another embodiment of the present invention, a high resolution display is provided. The high resolution display comprises a display panel. The display panel comprises a plurality of data lines and a plurality of scan lines. The display comprises a driver chip and a mainboard. The driver chip comprises a source driving module and a gate driving module. The source driving module is coupled to the plurality of data lines. The gate driving module is coupled to the plurality of scan lines. The mainboard generates a positive voltage and a negative voltage. The mainboard is coupled to the driver chip. The source driving module receives the positive or negative voltage and generates a plurality of source signals for the display panel. The gate driving module generates a plurality of scan signals and scans the display for displaying a frame.

DETAILED DESCRIPTION

In order to make the structure and characteristics as well as the effectiveness of the present invention to be further understood and recognized, the detailed description of the present invention is provided as follows along with embodiments and accompanying figures.

Figure 1:
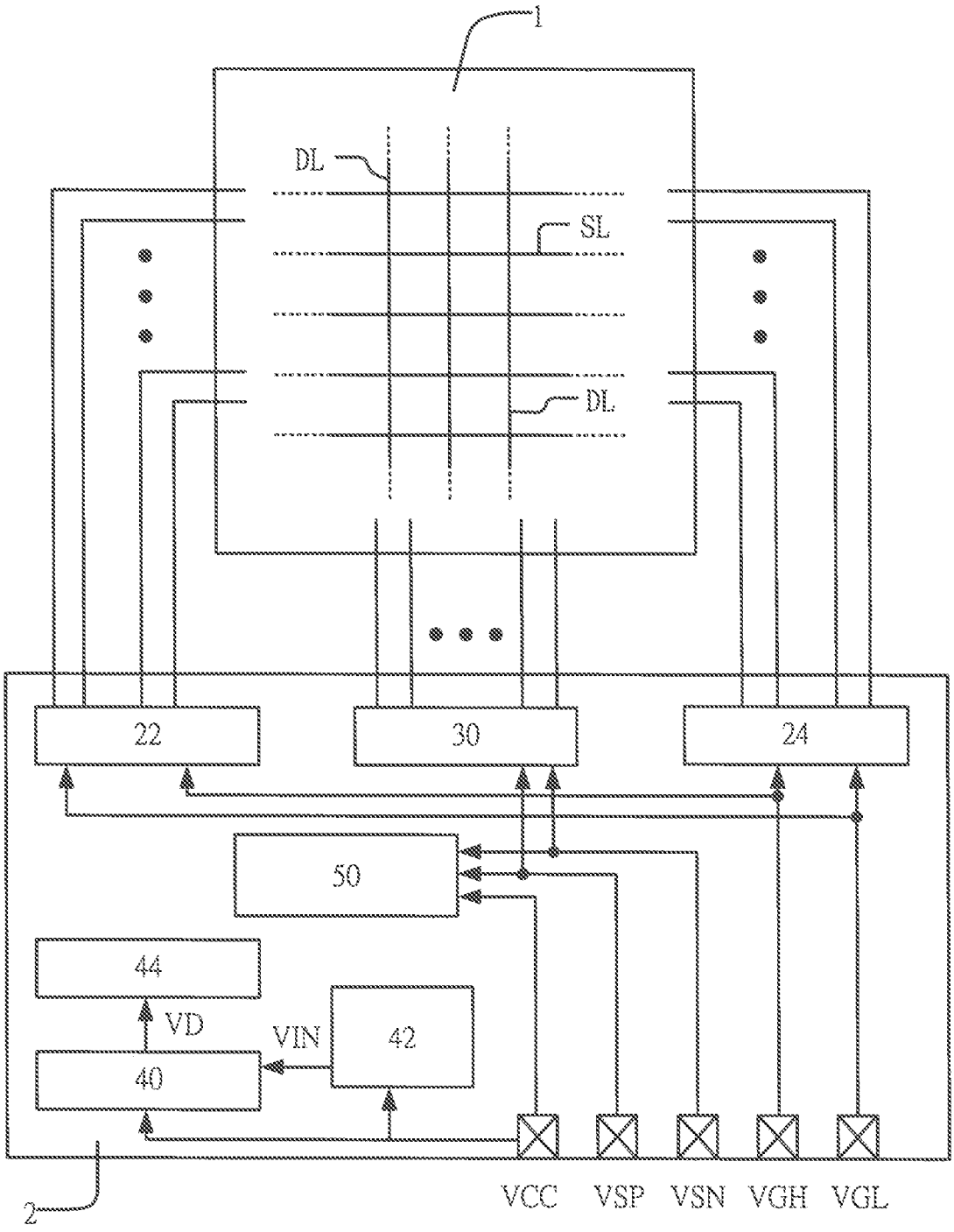
FIG. 1 shows a schematic diagram of the driver chip according a first embodiment of the present invention.

Please refer to FIG. 1, which shows a schematic diagram of the driver chip according to a first embodiment of the present invention. As shown in the figure, the driver chip 2 according to the present invention comprises gate driving modules 22, 24 and a source driving module 30. The gate driving modules 22, 24 are coupled to a display panel 1 and generate a plurality of scan signals. The plurality of scan signals scan the display panel via a plurality of scan lines SL of the display panel 1. Likewise, the source driving module 30 is coupled to the display panel 1 and drives the display panel 1 via a plurality of data lines DL of the display panel 1.

In addition, the driver chip 2 is further coupled to a mainboard 4, which generates a positive voltage VSP, a negative voltage VSN, a scan voltage VGH, and a cutoff voltage VGL. The source driving module 30 is coupled to the mainboard 4, receives the positive and negative voltages VSP, VSN, and uses them as a source input voltage for generating a plurality of source signals. The plurality of source signals drives the display panel 1 via the plurality of data lines DL. The source input voltage of the source driving module 30 is equal to the positive voltage VSP or the negative voltage VSN. Besides, the gate driving modules 22, 24 are coupled to the mainboard 4 as well. The scan voltage VGH and the cutoff voltage VGL generated by the mainboard 4 can be supplied to the driver chip 2 directly. Thereby, the gate driving modules 22, 24 receive the scan voltage VGH directly and generate the plurality of scan signals. The plurality of scan signals then scan the display panel 1 via the plurality of scan lines SL or receive the cutoff voltage directly for stopping scanning the display panel 1. Hence, the mainboard 4 according to the present invention generates the voltages directly required by the driver chip 2 and outputs them to the driver chip 2 directly. Consequently, according to the present invention, it is not necessary to dispose capacitors on the FPC for generating the voltages required by the driver chip 2. Then the display costs can be lowered.

The driver chip 2 according to the present invention supplies the positive voltage VSP, the negative voltage VSN, the scan voltage VGH, and the cutoff voltage VGL generated by the mainboard 4 to the source driving module 30 and the gate driving modules 22, 24 directly and generates the plurality of source signals and scan signals to the display panel 1 for displaying the frame. Thereby, even for the high resolution display panel 1, the voltages generated by the mainboard 4 can be supplied directly to the source driving module 30 and the gate driving modules 22, 24. No additional capacitor is required for generating various voltages required by the driver chip 2. Consequently, the display costs can be lowered and the layout area can be reduced.

Please refer again to FIG. 1. The driver chip 2 can further comprise a selection circuit 40, a reference voltage circuit 42, a digital module 44, and other circuit 50. The selection circuit 40 is coupled to the reference voltage circuit 42 and the mainboard 4, and receives a reference voltage VIN generated by the reference voltage circuit 42 and a supply voltage VCC generated by the mainboard 4. The digital module 44 is coupled to the selection circuit 40 and receives a supply voltage VD. The reference voltage circuit 42 can be a low dropout regulator (LDO). The selection circuit 40 selects one of the reference voltage VIN and the supply voltage VCC to be the supply voltage VD. The other circuit 50, likewise, can receive the supply voltage VCC, the voltage VCI, the positive voltage VSP, or the negative voltage VSN directly. The other circuit 50 according to the embodiments of the present invention includes, for example, the protection circuit or the timing controller of the driver chip 2. The other voltages required by the other circuit 50 can be generated by the mainboard 4 as well. The operating method will not be described again.

The digital module 44 inside the driver chip 2 is driven by the supply voltage VD. The supply voltage VD is selected by the selection circuit 40 from the supply voltage VCC generated by the mainboard 4 and the reference voltage VIN generated by the reference voltage circuit 42. Thereby, when the supply voltage VCC generated by the mainboard 4 can meet the requirements of the digital module 44, the digital module 44 receives the supply voltage VCC generated by the mainboard 4 directly for driving the display panel 1. Otherwise, the reference voltage VIN is received for driving the display panel 1.

Figure 2:
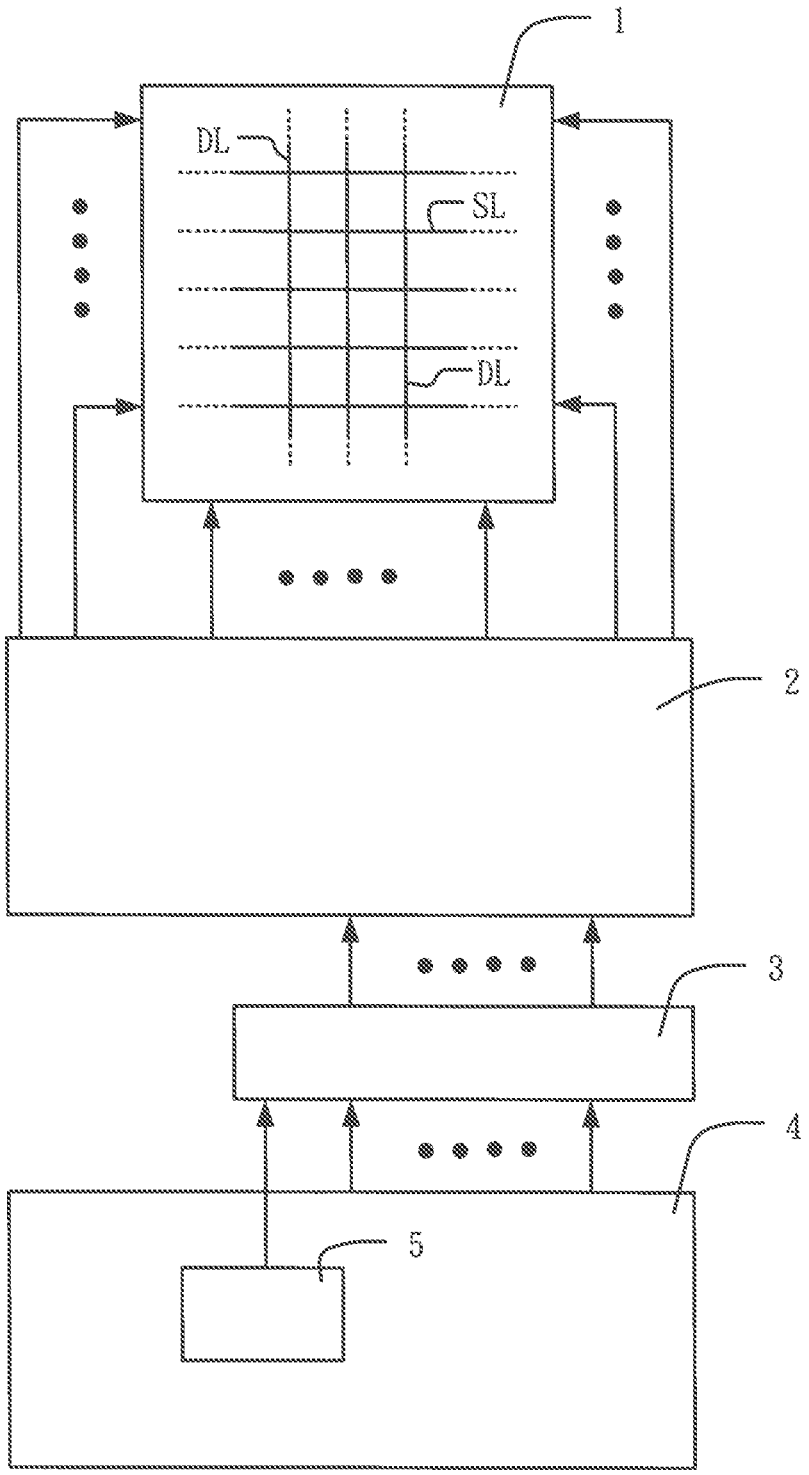
FIG. 2 shows a schematic diagram of the driver chip in a high resolution display according an embodiment of the present invention.

Please refer to FIG. 2, which shows a schematic diagram of the driver chip in a high resolution display according an embodiment of the present invention. As shown in the figure, as FPC 3 can be further included between the driver chip 2 and the mainboard 4. The mainboard 4 is coupled to the driver chip 2 via the FPC 3. In addition, the positive voltage VSP, the negative voltage VSN, the scan voltage VGH, the cutoff voltage VGL, and the supply voltage are supplied to the driver chip 2 through the FPC 3 without any capacitor. Moreover, the mainboard 4 can further include a control circuit 5, which controls the selection circuit 40 and thus controlling the voltage level of the supply voltage VD received by the digital module 44. The control circuit 5 can judge if the supply voltage VCC is lower than or higher than a threshold voltage before it controls the switching of the selection circuit 40 and determines the supply voltage VD. For example, when the supply voltage VCC is lower than the threshold voltage, the control circuit 5 controls the selection circuit 40 to output the supply voltage VCC to the digital module 44. As the supply voltage VCC is higher than the threshold voltage, the control circuit 5 controls the selection circuit 40 to output the reference voltage VIN to the digital module 44. Besides, a control signal of the control circuit 5 can be transmitted to the driver chip 2 via the FPC 3 as well.

Figure 3:
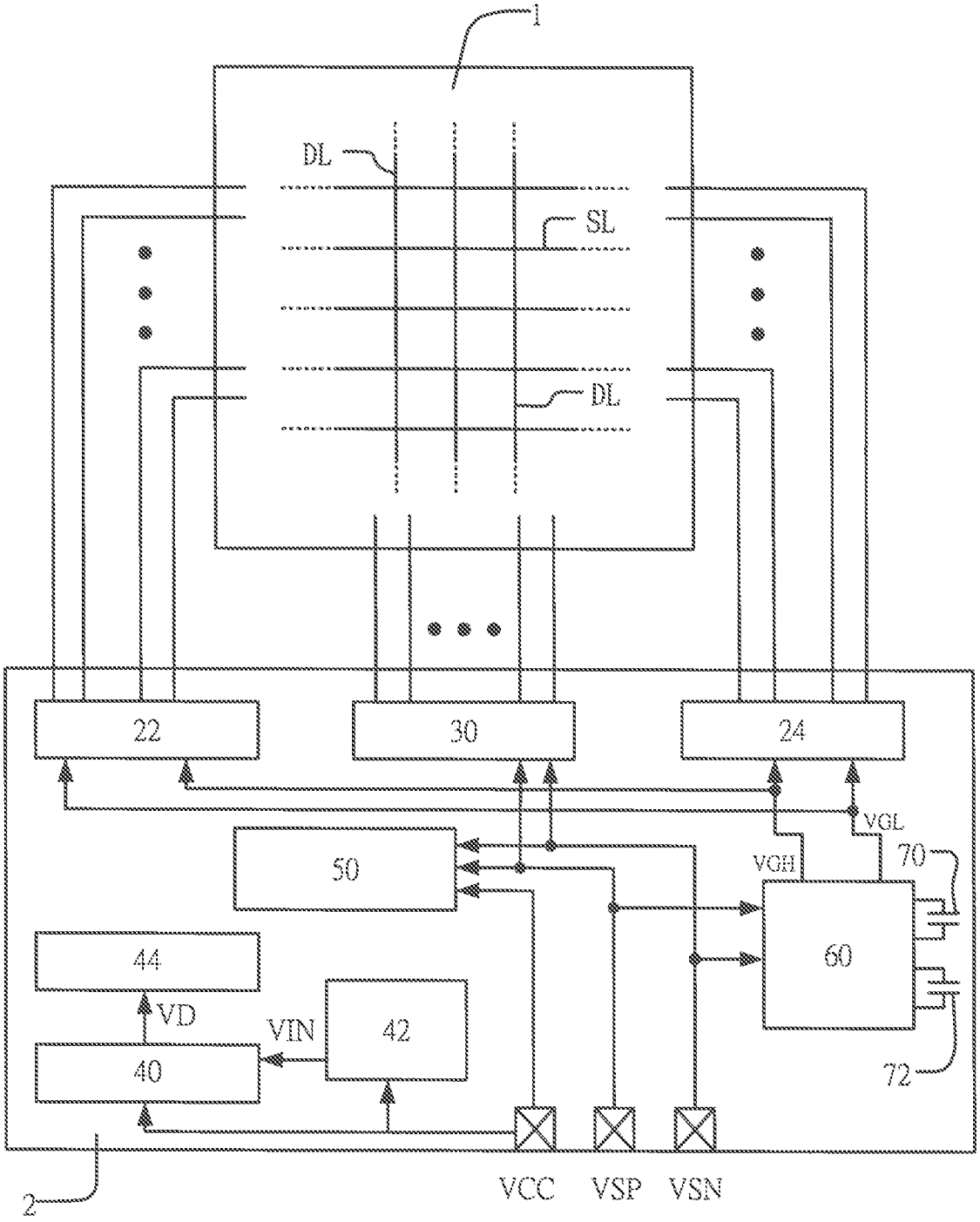
FIG. 3 shows s schematic diagram of the driver chip according a second embodiment of the present invention.
Figure 4:
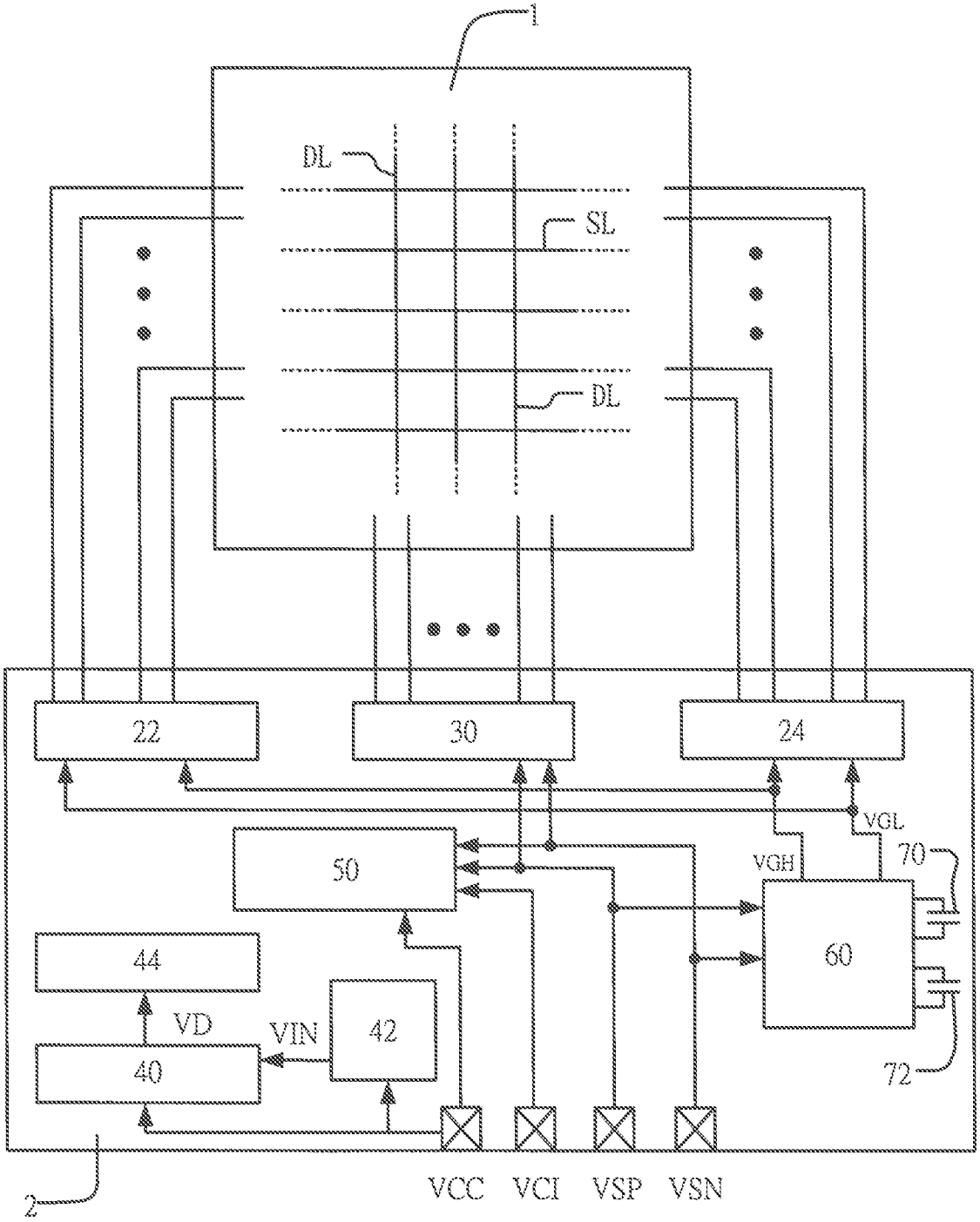
FIG. 4 shows a schematic diagram of the driver chip according a third embodiment of the present invention.

Please refer to FIG. 3, which shows a schematic diagram of the driver chip according a second embodiment of the present invention. As shown in the figure, the driver chip 2 can includes a charge pump 60, which includes one or more capacitors 70, 72 and receives the positive voltage VSP and the negative voltage VSN supplied from the mainboard 4. The charge pump 60 uses the positive voltage VSP and the negative voltage VSN in generating the scan voltage VGH and the cutoff voltage VGL, so that the gate driving modules 22, 24 receive the scan voltage VGH to generate the scan signals for scanning the display panel 1 and the cutoff voltage VGL for stopping scanning. Thereby, according to the present embodiment, the voltage levels of the scan voltage VGH and the cutoff voltage VGL generated by the charge pump 60 are not equal to the voltage levels of the positive and negative voltages VSP, VSN.

Moreover, the mainboard 4 can further include a power supply circuit, which generates a plurality of supply voltages used for generating the scan voltage VGH and the cutoff voltage VGL, respectively. Thereby, in addition to generating the scan voltage VGH and the cutoff voltage VGL using the positive and negative voltages VSP, VSN, they can be generated using other power supply circuits and other voltage generating circuits on the mainboard 4 as well. Accordingly, the present invention does not limit the method for generating the scan voltage VGH and the cutoff voltage VGL.

According to the present invention, although a plurality of capacitors 70, 72 are added to the driver chip 2, the driver chip 2 still can selectively use the voltages supplied by the mainboard 4. Nonetheless, if the mainboard 4 supplies only the positive and negative voltages VSP, VSN, the charge pump 60 can used for charging the capacitors 70, 72 according to fee positive and negative voltages VSP, VSN and generating the scan voltage VGH and the cutoff voltage VGL for the gate driving modules 22, 24. In addition, as applied to a high resolution display, because the power consumption of the gate driving modules 22, 24 is lower than the source driving module 30, the charge pump 60 does not require large capacitors 70, 72. Hence, instead of on the FPC 3, the capacitors 70, 72 can be disposed on the driver chip 2 directly.

To sum up, the driver chip according to the present invention includes the gate driving modules and the source driving module. The source driving module generates the source input voltage required by the source signals and supplied by the positive and negative voltages provided by the mainboard directly. The gate driving modules uses the mainboard to provide the scan voltage and the cutoff voltage directly for generating the scan signals. Alternatively, the positive and negative voltages generated by the mainboard and be used by the charge pump for charging and generating the scan voltage and the cutoff voltage. Thereby, the number of capacitors disposed on the FPC can be reduced and thus lowering the display costs. In addition to the gate and source driving modules, the driver chip further includes the digital module. The supply voltage required by the digital modules is selected by the selection circuit from the supply voltage provided by the mainboard and the reference voltage provided by the reference circuit. It prevents inability of normal operation due to an excessively high supply voltage. According to the present invention, the voltage generated by the mainboard are adopted directly and used as the various voltages required by the driver chip. Hence, no capacitor is required on the FPC, and the volume and costs of the driver chip as well as the display can be both reduced.

Accordingly, the present invention conforms to the legal requirements owing to its novelty, nonobviousness, and utility. However, the foregoing description, is only embodiments of the present invention, not used to limit the scope and range of the present invention. Those equivalent changes or modifications made according to the shape, structure, feature, or spirit described in the claims of the present invention are included in the appended claims of the present invention.

The invention claimed is:

1. A driver chip, comprising:

a gate driving module coupled to a display panel, and generating a plurality of scan signals to scan said display panel via a plurality of scan lines; and a source driving module coupled to said display panel, and generating a plurality of source signals based on a positive voltage and a negative voltage to drive said display panel via a plurality of data lines;

where said source driving module is coupled to a mainboard, and an input of said source driving module receives said positive voltage and said negative voltage from said mainboard, said positive voltage or said negative voltage is not converted to be served as a source input voltage of said source driving module; and said driver chip is disposed separately from said mainboard and said mainboard is coupled to said driver chip via a flexible printed circuit having no capacitor used for boosting voltage.

2. The driver chip of claim 1, wherein said mainboard further generates a scan voltage and a cutoff voltage;

said gate driving module receives said scan voltage and generates said plurality of scan signals;

said plurality of scan signals scan said display panel via said plurality of scan lines; and said gate driving module receives said cutoff voltage and stops scanning said display panel.

3. The driver chip of claim 1, wherein the voltage level of said source input voltage at said driver chip is equal to the voltage level of said positive voltage or said negative voltage at said mainboard;

said driver chip generates a scan voltage and a cutoff voltage each based on at least one of said positive voltage and said negative voltage from said mainboard;

said gate driving module receives said scan voltage and generates said plurality of scan signals based thereon;

said gate driving module receives said cutoff voltage and stops scanning said display panel; and the voltage level of said scan voltage at said driver chip is not equal to the voltage levels of said positive voltage and said negative voltage at said mainboard.

4. The driver chip of claim 3, further comprising a charge pump and one or more capacitors; wherein said charge pump is coupled between said mainboard and said gate driving module; and said charge pump uses said capacitors to raise the voltage levels of said positive voltage and said negative voltage from said mainboard for generating said scan voltage and said cutoff voltage to said gate driving module at said driver chip.

5. The driver chip of claim 1, further comprising a selection circuit, a voltage regulator circuit, and a digital module; wherein said digital module is coupled to said selection circuit and receives a first supply voltage for controlling said display panel;

said selection circuit is coupled to said mainboard and said voltage regulator circuit; and according to a second supply voltage generated from said mainboard, said selection circuit determines outputting said second supply voltage generated from said mainboard or a reference voltage generated by said voltage regulator circuit as said first supply voltage of said digital module.

6. The driver chip of claim 5, wherein a control circuit of said mainboard is coupled to said selection circuit of said driver chip;

when said second supply voltage is lower than a threshold voltage, said control circuit controls said selection circuit to output said second supply voltage to said digital module; and when said second supply voltage is higher than said threshold voltage, said control circuit controls said selection circuit to output said reference voltage to said digital module.

7. A high resolution display, comprising:

a display panel having a plurality of data lines and a plurality of scan lines;

a driver chip having a source driving module and a gate driving module, said source driving module coupled to said plurality of data lines, and said gate driving module coupled to said plurality of scan lines; and a mainboard generating a positive voltage and a negative voltage, coupled to said driver chip, said source driving module of said driver chip receiving said positive voltage and said negative voltage from said mainboard and generating a plurality of source signals to said display panel based on at least one of said positive and negative voltages, said gate driving module generating a plurality of scan signals and scanning said display panel for displaying a frame, said positive voltage or said negative voltage is not converted to be served as a source input voltage of said source driving module located on said driver chip;

where said driver chip is disposed separately from said mainboard and said mainboard is coupled to said driver chip via a flexible printed circuit having no capacitor used for boosting voltage.

8. The display of claim 7, wherein said mainboard further generates a scan voltage and a cutoff voltage;

said gate driving module receives said scan voltage and generates said plurality of scan signals;

said plurality of scan signals scan said display panel via said plurality of scan lines; and said gate driving module receives said cutoff voltage and stops scanning said display panel.

9. The display of claim 7, wherein the voltage level of said source input voltage at said driver chip is equal to the voltage level of said positive voltage or said negative voltage at said mainboard;

said driver chip generates a scan voltage and a cutoff voltage each based on at least one of said positive voltage and said negative voltage from said mainboard;

said gate driving module receives said scan voltage and said cutoff voltage for starting or stopping scanning said display panel via said plurality of scan lines; and the voltage levels of said scan voltage and said cutoff voltage at driver chip are not equal to the voltage levels of said positive voltage and said negative voltage at said mainboard.

10. The display of claim 9, wherein said driver chip further comprises a charge pump and one or more capacitors;

said charge pump is coupled between said mainboard and said gate driving module; and said charge pump uses said capacitors to raise the voltage levels of said positive voltage and said negative voltage from said mainboard for generating said scan voltage and said cutoff voltage to said gate driving module at said driver chip.

11. The display of claim 7, wherein said driver chip further comprises a selection circuit, a voltage regulator circuit, and a digital module;

said digital module is coupled to said selection circuit and receives a first supply voltage for controlling said display panel;

said selection circuit is coupled to said mainboard and said voltage regulator circuit; and according to a second supply voltage generated by said mainboard, said selection circuit determines outputting said second supply voltage generated by said mainboard or a reference voltage generated by said voltage regulator circuit as said first supply voltage of said digital module at said driver chip.

12. The display of claim 11, further comprising a control circuit of said mainboard coupled to said selection circuit of said driver chip;

when said second supply voltage is lower than a threshold voltage, said control circuit controlling said selection circuit to output said second supply voltage to said digital module; and when said second supply voltage is higher than said threshold voltage, said control circuit controlling said selection circuit to output said reference voltage to said digital module.

13. The display of claim 7, further comprising said flexible printed circuit, coupled between said mainboard and said driver chip for receiving and supplying said positive voltage and said negative voltage from said mainboard to said driver chip.

14. The display of claim 13, wherein no capacitor on said flexible printed circuit is coupled between said driver chip and said mainboard to supply said positive voltage and said negative voltage.

* * * * *